US012215409B2

(12) United States Patent
Li et al.

(10) Patent No.: US 12,215,409 B2
(45) Date of Patent: Feb. 4, 2025

(54) HIGH-STRENGTH AND HIGH-CORROSION-RESISTANT TERNARY MAGNESIUM ALLOY AND PREPARATION METHOD THEREOF

(71) Applicant: Shanghai Jiao Tong University, Shanghai (CN)

(72) Inventors: Yangxin Li, Shanghai (CN); Xiaoqin Zeng, Shanghai (CN); Qingchun Zhu, Shanghai (CN); Tao Ying, Shanghai (CN)

(73) Assignee: Shanghai Jiao Tong University, Shanghai (CN)

( * ) Notice: Subject to any disclaimer, the term of this patent is extended or adjusted under 35 U.S.C. 154(b) by 46 days.

(21) Appl. No.: 17/793,044

(22) PCT Filed: Mar. 15, 2021

(86) PCT No.: PCT/CN2021/080828
§ 371 (c)(1),
(2) Date: Jul. 15, 2022

(87) PCT Pub. No.: WO2021/185209
PCT Pub. Date: Sep. 23, 2021

(65) Prior Publication Data

US 2023/0069275 A1 Mar. 2, 2023

(30) Foreign Application Priority Data

Mar. 19, 2020 (CN) ..... 202010198047.9

(51) Int. Cl.
*C22C 1/03* (2006.01)
*C22C 23/06* (2006.01)
(Continued)

(52) U.S. Cl.
CPC ..... *C22C 1/03* (2013.01); *C22C 23/06* (2013.01); *C22F 1/002* (2013.01); *C22F 1/06* (2013.01)

(58) Field of Classification Search
CPC . C22C 1/03; C22C 23/06; C22F 1/002; C22F 1/06
See application file for complete search history.

(56) References Cited

U.S. PATENT DOCUMENTS

2016/0215372 A1 7/2016 Pulugurtha et al.
2020/0173002 A1* 6/2020 Somekawa ..... C22C 23/06

FOREIGN PATENT DOCUMENTS

CN 102242300 A * 11/2011
CN 102628135 8/2012
(Continued)

OTHER PUBLICATIONS

Zhang et al., "Revisiting building block ordering or long-period stacking ordered structures in Mg—Y—Al alloys," Acta Materialia, 152 ( 2018), pp. 96-106 (Year: 2018).*
(Continued)

*Primary Examiner* — John A Hevey
(74) *Attorney, Agent, or Firm* — JCIPRNET

(57) ABSTRACT

The present invention relates to a high-strength, high-corrosion resistance ternary magnesium alloy and a preparation method therefor, the magnesium alloy comprising the following element components by mass percentage: 8-12 wt % of Y, 0.6-3 wt % of Al and the remainder being Mg. The method comprises: (1) under a protective atmosphere, preparing a Mg—Y intermediate alloy, an aluminum ingot and a magnesium ingot into a magnesium alloy melt; (2) under a protective atmosphere, allowing the magnesium alloy melt to stand after stirring, then carrying out refining, degassing, and slag removal, allowing the magnesium alloy melt to stand again, then thermally insulating to obtain a magnesium
(Continued)

alloy liquid; and (3) casting and molding the magnesium alloy liquid under a protective atmosphere, and forming a cast ingot; the three steps above ultimately obtain a high-strength, high-corrosion resistance ternary magnesium alloy.

6 Claims, 1 Drawing Sheet

(51) Int. Cl.
*C22F 1/00* (2006.01)
*C22F 1/06* (2006.01)

(56) References Cited

FOREIGN PATENT DOCUMENTS

| | | | |
|---|---|---|---|
| CN | 104152732 A | * | 11/2014 |
| CN | 105543605 | | 5/2016 |
| CN | 106636821 | | 5/2017 |
| CN | 108570588 | | 9/2018 |
| CN | 109930044 A | * | 6/2019 |
| CN | 111304510 | | 6/2020 |
| JP | 2005281735 | | 10/2005 |
| JP | 2005281735 A | * | 10/2005 |

OTHER PUBLICATIONS

CN-104152732-A, Zhong et al. (machine translation). (Year: 2014).*
CN-102242300-A, Shu et al. (machine translation). (Year: 2011).*
JP-2005281735-A, Azuma et al. (machine translation) (Year: 2005).*
CN-109930044-A, Liu et al., machine translation. (Year: 2019).*
H. Zhang et al., "Revisiting building block ordering of long-period stacking ordered structures in MgeYeAl alloys", Acta Materialia, Apr. 11, 2018, pp. 96-106.
J. Vratna et al., "Room temperature corrosion properties of AZ31 magnesium alloy processed by extrusion and equal channel angular pressing", Nanostructured Materials, Feb. 1, 2013, pp. 4510-4516.
D. Orlov et al., "Enhanced corrosion resistance of Mg alloy ZK60 after processing by integrated extrusion and equal channel angular pressing", Acta Materialia, Jul. 6, 2011, pp. 6176-6186.
"International Search Report (Form PCT/ISA/210) of PCT/CN2021/080828," mailed on Jun. 11, 2021, with English translation thereof, pp. 1-6.

* cited by examiner

HIGH-STRENGTH AND HIGH-CORROSION-RESISTANT TERNARY MAGNESIUM ALLOY AND PREPARATION METHOD THEREOF

CROSS-REFERENCE TO RELATED APPLICATION

This application is a 371 of international application of PCT application serial no. PCT/CN2021/080828, filed on Mar. 15, 2021, which claims the priority benefit of China application no. 202010198047.9, filed on Mar. 19, 2020. The entirety of each of the above mentioned patent applications is hereby incorporated by reference herein and made a part of this specification.

TECHNICAL FIELD

The present disclosure relates to the technical field of magnesium alloys, in particular to a high-strength and high-corrosion-resistant ternary magnesium alloy and a preparation method thereof.

DESCRIPTION OF RELATED ART

Magnesium alloy is the lightest among commonly used metal material. Thanks to its low density, high specific strength and rigidity, and high thermal conductivity and damping performance, it enjoys an extremely broad application prospect. However, its relatively low absolute strength and unsatisfactory mechanical properties, along with its corrosion resistance, greatly limit its application. Magnesium is an active metal in terms of chemical properties, which is determined by its thermodynamic performance. With the standard electrode potential of ~2.38 $V_{NHE}$, it generally corroded as an anode of galvanic corrosion in applications. Nevertheless, unlike aluminum and other metals, its oxide film is MgO or $Mg(OH)_2$ with a pilling-bedworth ratio (PBR) lower than 1. Such a film is not dense, and thus can't prevent aggravated corrosion caused by further oxidation, leading to poor service of magnesium alloy in a relatively humid environment.

At present, the most prominent factors restricting the industrial application of magnesium alloy are its low absolute mechanical properties and poor corrosion resistance. The following methods are often used to enhance mechanical performance: grain refinement, work hardening and second-phase particle strengthening. For magnesium, in most cases, second-phase particle strengthening causes plasticity loss and galvanic corrosion increase, resulting in reduced corrosion resistance. In general, the result of work hardening is relatively good. However, Due to its poor plasticity, magnesium alloy's hardening result is limited, and thus it is necessary to find a suitable processing and deformation technique. Grain refinement can increase strength, and is generally believed to improve corrosion resistance. Zirconium (Zr) is commonly used as a refiner for magnesium alloy. Despite its good refinement effect, the refiner has high cost and consumption rate. Generally, solutions to improve corrosion resistance include anodic oxidation, chemical conversion coating and surface coating treatment. But their application is very limited because of cost, and usage of a large quantity of materials which may cause severe pollution to the environment.

Therefore, a magnesium alloy with high strength and corrosion resistance, which forms a protective oxide film during corrosion, is needed.

SUMMARY

An objective of the present disclosure is to provide a high-strength and high-corrosion-resistant ternary magnesium alloy with good corrosion resistance, high mechanical properties, and low sensitivity to impurity iron, and a preparation method thereof, in order to overcome the defects of the above-mentioned prior art.

The objective of the present disclosure may be achieved through the following technical solution:

A high-strength and high-corrosion-resistant ternary magnesium alloy, wherein the magnesium alloy includes the following elements in percentage by weight: 8-12 wt. % of Y, 0.6-3 wt. % of Al, and the balance of Mg.

The magnesium alloy also includes inevitable impurity elements, the content of impurity element Fe does not exceed 0.1 wt %, the content of impurity element Cu does not exceed 0.02 wt %, and the content of impurity element Ni does not exceed 0.003 wt %.

As a preferred solution, in the above elements, the weight percentage of Y is 8-11 wt %, the weight percentage of Al is 0.8-1.5 wt %, the content of impurity element Fe does not exceed 0.02 wt %, the content of Cu does not exceed 0.01 wt %, and the content of Ni does not exceed 0.0005 wt %.

A preparation method of the above-mentioned high-strength and high-corrosion-resistant ternary magnesium alloy, wherein the method includes the following steps:

(1) Under a protective atmosphere, preparing a magnesium alloy melt from an Mg—Y master alloy, an aluminum ingot and a magnesium ingot;

(2) Under the protective atmosphere, stirring the magnesium alloy melt, holding, then performing refined degassing and deslagging, holding again, and performing heat preservation to obtain a magnesium alloy liquid; and (3) Under the protective atmosphere, casting the magnesium alloy liquid into a mold to form an ingot, and finally obtaining the corrosion-resistant ternary magnesium alloy.

Further, preparing the magnesium alloy melt comprises the following specific steps: under the protective atmosphere, after the magnesium ingot with the purity of no less than 99.9 wt % is melted, adding the Mg—Y master alloy and the aluminum ingot at a high temperature, and after the Mg—Y master alloy and the aluminum ingot are melted, obtaining the magnesium alloy melt. Preferably, the raw materials are completely melted in a well-type resistance crucible furnace to obtain the magnesium alloy melt.

Further, a protective gas is a mixed gas of $SF_6$ and $CO_2$, and the temperature at which the Mg—Y master alloy and the aluminum ingot are added is 660-700° C. The weight of the Mg—Y master alloy, the aluminum ingot and the magnesium ingot should be determined according to different components of the Mg—Y master alloy, the raw materials including 8-12 wt % of Y, 0.6-3 wt % of pure aluminum, and the balance of pure magnesium are prepared, and the temperature at which the Mg—Y master alloy and the aluminum ingot are added is 660-700° C.

Further, the holding temperature after stirring is 720-740° C., and the holding time is 20-60 min; the temperature of refined degassing and slagging is 730-750° C.; and the temperature of heat preservation is 720-740° C., and the time of heat preservation is 20-60 min.

Further, the ingot is solution-treated to obtain the corrosion-resistant ternary magnesium alloy.

Further, the ingot is solution-treated, and then is extruded and water-quenched to obtain the corrosion-resistant ternary magnesium alloy.

Further, the temperature of solution treatment is 500-580° C., the time of solution treatment is 8-24 h, the temperature of extrusion is 300-450° C., an extrusion ratio is (9-30):1, and an outflow speed of an extruded section is 3-10 m/min.

According to the present disclosure, Y and Al with the larger PBR are added into the magnesium alloy, and $Y_2O_3$ and $Al_2O_3$ are obtained after oxidation, which may significantly enhance the density of an oxide film and overcome the defects of MgO's looseness and porosity. Besides, $Al_2O_3$, $Y_2O_3$ and MgO have good compatibility, and the effect of enhancing the corrosion resistance of the magnesium alloy is very obvious, so that the alloy has good corrosion resistance.

Meanwhile, because an Mg—Y binary alloy is a eutectic system, grains are relatively coarse (about 200 microns). The addition of a small amount of Al will cause $Al_2Y$ particles to be formed in the alloy as nucleating particles to induce grain refinement, the grain size of the alloy with relatively high Y content may be reduced to 30-40 microns in an as-cast state, and its grain refinement effect is comparable to that of Zr. The grains may be refined to a few microns after extrusion deformation. The refinement of the grains will make the alloy with a more uniform electric potential distribution and thus weaken the galvanic corrosion effect of the alloy.

As shown in FIG. 1, a long period stacking ordered (LPSO) phase distributed near a grain boundary in the alloy plays a cathodic protection effect at this time to make the film on the surface exist stably; and the existence of the LPSO phase has a great contribution to the mechanical properties of the alloy.

Main secondary phases in the corrosion-resistant ternary magnesium alloy prepared by the present disclosure are the lath-shaped LPSO phase and $Al_2Y$ particles. The two phases are relatively difficult to change in various heat treatments. LPSO laths may pin the grain boundary, and structural grains grow up, so that this alloy may be strengthened by various heat treatment means to improve the mechanical properties without losing corrosion resistance.

A very important problem in the corrosion resistance of the magnesium alloy is that most iron cannot be melted in the alloy, which leads to the use of special molds in a melting and processing technology of magnesium, instead of ordinary steel, or the special addition of a one-step iron removal technology that is quite high in cost. The magnesium alloy involved in the present disclosure has lower iron content requirements, and a general processing way may meet the corrosion resistance requirements, so that the cost is greatly reduced.

Specifically, the present disclosure does not require high impurity Fe removal. Generally, the theoretical tolerance limit of Fe in the magnesium alloy is 180 ppm (0.18 wt %), while the content of Fe in the corrosion-resistant ternary magnesium alloy prepared by the present disclosure may be above this value and may be higher than 500 ppm (0.5 wt %) in extreme cases. For industrial production, special production equipment is not required, and ordinary equipment may meet the requirements.

Compared with the prior art, the present disclosure has the following advantages:

(1) According to the present disclosure, Y and Al with the larger PBR are added into the magnesium alloy, and $Y_2O_3$ and $Al_2O_3$ are obtained after oxidation, which may significantly enhance the density of the oxide film and overcome the defects of MgO's looseness and porosity. Besides, $Al_2O_3$, $Y_2O_3$ and MgO have good compatibility, and the effect of enhancing the corrosion resistance of the magnesium alloy is very obvious, so that the alloy has good corrosion resistance. After the alloy is soaked in 3.5 wt % of an NaCl aqueous solution for 336 h at room temperature, the hydrogen evolution rate of the alloy may be less than 0.1 $ml/cm^{-2}\cdot day^{-1}$, and the weight loss rate may be less than 0.14 $mg/cm^{-2}\cdot day^{-1}$.

(2) In the alloy formed after solution treatment, extrusion, and water quenching, the LPSO phase distributed near the grain boundary plays the cathodic protection effect to make the film on the surface exist stably, the great contribution is also made to the mechanical properties of the alloy, and the corrosion-resistant ternary magnesium alloy prepared by the present disclosure may achieve the tensile strength of 350 MPa and the elongation rate of 15% and has the better mechanical properties and stability. At present, a medium and high-strength magnesium alloy that is not publicly reported has better corrosion resistance than the magnesium alloy prepared by the present disclosure.

(3) The corrosion-resistant ternary magnesium alloy prepared by the present disclosure is not highly sensitive to Fe with a great influence in the prior art, and may still maintain good corrosion resistance under the Fe content of 1,000 ppm. After the alloy is soaked in 3.5 wt % of the NaCl aqueous solution for 336 h at room temperature, the hydrogen evolution rate of the alloy may be less than 0.15 $ml/cm^{-2}\cdot day^{-1}$, and the weight loss rate may be less than 0.2 $mg/cm^{-2}\cdot day^{-1}$. An analysis on the corroded film found that there is no large amount of iron enriched in the film to form corrosion pits, and the formed film has a good protective effect.

(4) The high-strength and high-corrosion-resistant ternary magnesium alloy prepared by the present disclosure realizes the unification of high strength, high plasticity and high corrosion resistance in a simple and easy-to-industrialize way, and has excellent performance, relatively low cost and good industrial application value.

DESCRIPTION OF THE EMBODIMENTS

The present disclosure is described in detail below with reference to the accompanying drawings and specific examples.

Example 1

A method for preparing a ternary magnesium alloy in this embodiment, under a protective atmosphere (a protective gas is a mixed gas of $SF_6$ and $CO_2$), includes the following steps:

(1) Under the protective atmosphere (the protective gas is the mixed gas of $SF_6$ and $CO_2$), after a magnesium ingot with the purity of not less than 99.9 wt % was melted, an Mg—Y master alloy and an aluminum ingot were added at 660-700° C., and after the Mg—Y master alloy and the aluminum ingot were melted, a magnesium alloy melt was obtained.

(2) Under the protective atmosphere (the protective gas is the mixed gas of $SF_6$ and $CO_2$), the magnesium alloy melt was stirred at 730-740° C. and then was held for 20 min, then was subjected to refined degassing and deslagging at 740-750° C., was subjected to holding again, and was subjected to heat preservation at 730-740° C. for 30 min to obtain a magnesium alloy liquid.

(3) Under the protective atmosphere (the protective gas is the mixed gas of $SF_6$ and $CO_2$), the magnesium alloy liquid was subjected to cast molding to obtain an ingot.

Figure 1:
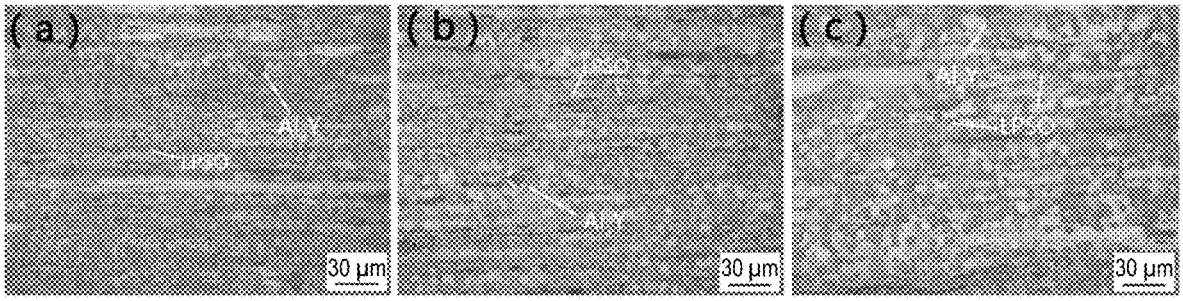
FIG. 1 is a picture of a metallographic structure of a high-strength and high-corrosion-resistant ternary magnesium alloy prepared by the present disclosure.
Figure 2:
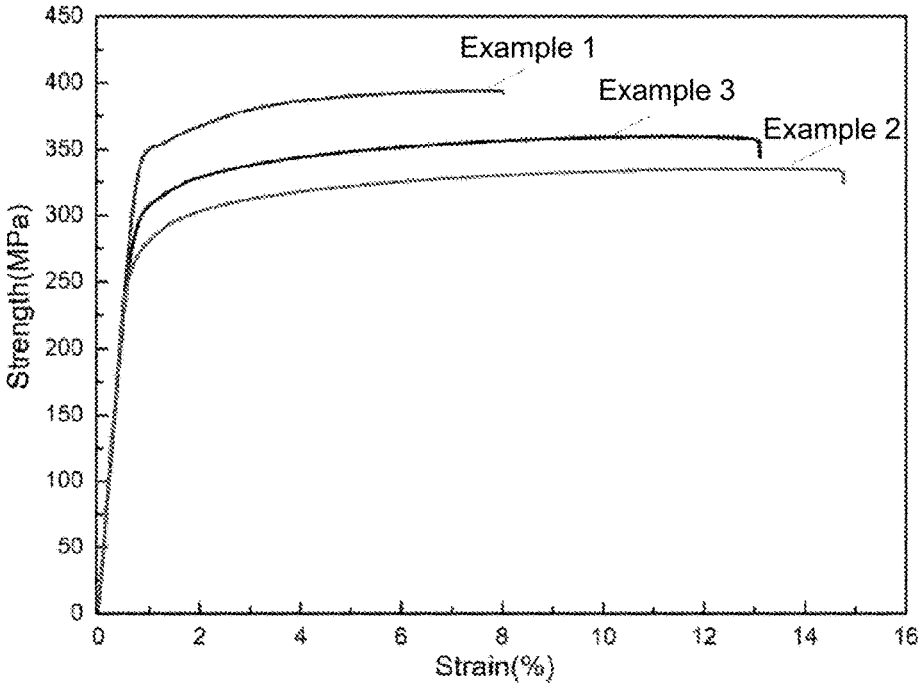
FIG. 2 is a typical tensile curve diagram of the high-strength and high-corrosion-resistant ternary magnesium alloy prepared by the present disclosure.

(4) The ingot was put into an air furnace to be solution-treated at 550° C. for 16 h, then a heat preserving furnace was heated to 350° C., the solution-treated material was put into the heat preserving furnace to be preheated for 45 min, an extrusion mold was heated to 350° C. and subjected to heat preservation for 1 h, then hot extrusion was performed according to an extrusion ratio of about 16:1, an outflow speed of a section was controlled to be 8 m/min, and finally the high-strength and high-corrosion-resistant ternary magnesium alloy was obtained, as shown in FIG. 1(*a*).

After testing, the chemical components and percentages of the magnesium alloy obtained in this embodiment are as follows: Y: 10.4 wt %, Al: 0.82 wt %, impurity element Fe: 0.018 wt %, impurity element Cu: 0.01 wt %, impurity element Ni: 0.002 wt %, and the balance of magnesium. Its mechanical properties and hydrogen evolution performance are shown in Table 1.

Example 2

A method for preparing a novel corrosion-resistant ternary magnesium alloy in this embodiment includes the following steps:

(1) Under a protective atmosphere (a protective gas is a mixed gas of $SF_6$ and $CO_2$), after a magnesium ingot with the purity of not less than 99.9 wt % was melted, an Mg—Y master alloy and an aluminum ingot were added at 660-700° C., and after the Mg—Y master alloy and the aluminum ingot were melted, a magnesium alloy melt was obtained.

(2) Under the protective atmosphere (the protective gas is the mixed gas of $SF_6$ and $CO_2$), the magnesium alloy melt was stirred at 730-740° C. and then was held for 20 min, then was subjected to refined degassing and deslagging at 740-750° C., was subjected to holding again, and was subjected to heat preservation at 730-740° C. for 30 min to obtain a magnesium alloy liquid.

(3) Under the protective atmosphere (the protective gas is the mixed gas of $SF_6$ and $CO_2$), the magnesium alloy liquid was subjected to cast molding to obtain an ingot.

(4) The ingot was put into an air furnace to be solution-treated at 520° C. for 8 h, then a heat preserving furnace was heated to 375° C., the solution-treated material was put into the heat preserving furnace to be preheated for 45 min, an extrusion mold was heated to 375° C. and subjected to heat preservation for 1 h, then hot extrusion was performed according to an extrusion ratio of about 16:1, an outflow speed of a section was controlled to be 8 m/min, and finally the high-strength and high-corrosion-resistant ternary magnesium alloy was obtained, as shown in FIG. 1(*b*).

After testing, the chemical components and percentages of the magnesium alloy obtained in this embodiment are as follows: Y: 10.4 wt %, Al: 0.82 wt %, impurity element Fe: 0.018 wt %, impurity element Cu: 0.01 wt %, impurity element Ni: 0.002 wt %, and the balance of magnesium. Its mechanical properties and hydrogen evolution performance are shown in Table 1.

Example 3

A method for preparing a novel corrosion-resistant ternary magnesium alloy in this embodiment includes the following steps:

(1) Under a protective atmosphere (a protective gas is a mixed gas of $SF_6$ and $CO_2$), after a magnesium ingot with the purity of not less than 99.9 wt % was melted, an Mg—Y master alloy and an aluminum ingot were added at 660-700° C., and after the Mg—Y master alloy and the aluminum ingot were melted, a magnesium alloy melt was obtained.

(2) Under the protective atmosphere (the protective gas is the mixed gas of $SF_6$ and $CO_2$), the magnesium alloy melt was stirred at 730-740° C. and then was held for 20 min, then was subjected to refined degassing and deslagging at 720-730° C., was subjected to holding again, and was subjected to heat preservation at 720-730° C. for 30 min to obtain a magnesium alloy liquid.

(3) Under the protective atmosphere (the protective gas is the mixed gas of $SF_6$ and $CO_2$), the magnesium alloy liquid was subjected to cast molding to obtain an ingot.

(4) The ingot was put into an air furnace to be solution-treated at 550° C. for 16 h, then a heat preserving furnace was heated to 375° C., the solution-treated material was put into the heat preserving furnace to be preheated for 45 min, an extrusion mold was heated to 375° C. and subjected to heat preservation for 1 h, then hot extrusion was performed according to an extrusion ratio of about 25:1, an outflow speed of a section was controlled to be 8 m/min, and finally the high-strength and high-corrosion-resistant ternary magnesium alloy was obtained, as shown in FIG. 1(*c*).

After testing, the chemical components and percentages of the magnesium alloy obtained in this embodiment are as follows: Y: 10.4 wt %, Al: 0.82 wt %, impurity element Fe: 0.04 wt %, impurity element Cu: 0.01 wt %, impurity element Ni: 0.002 wt %, and the balance of magnesium. Its mechanical properties and hydrogen evolution performance are shown in Table 1.

Performance Testing:

1. Hydrogen Evolution and Weight Loss Testing:

The high-strength and high-corrosion-resistant ternary magnesium alloy obtained in Examples 1-3 was soaked in 3.5 wt % of an NaCl solution for 336 h, and hydrogen evolution and weight loss testing was performed. Results are shown in Table 1.

TABLE 1

| Alloy | Hydrogen evolution rate ($ml/cm^{-2} \cdot day^{-1}$) | Yield strength (MPa) | Elongation rate (%) |
|---|---|---|---|
| Example 1 | 0.05 | 350 | 8 |
| Example 2 | 0.08 | 273 | 15 |
| Example 3 | 0.07 | 300 | 13.5 |

Table 1 shows the hydrogen evolution rate, yield strength and elongation rate of the high-strength and high-corrosion-resistant ternary magnesium alloy prepared by the present disclosure soaked in 3.5 wt % of the NaCl aqueous solution for 336 h at room temperature. It reveals that the hydrogen evolution rate is not more than 0.1 $ml/cm^{-2} \cdot day^{-1}$, the yield strength is greater than 250 MPa, and the elongation rate is greater than 8%.

It may be seen from Table 1 that the high-strength and high-corrosion-resistant ternary magnesium alloy in Example 1 has the best performance, with the hydrogen evolution rate of 0.05 $ml/cm^{-2} \cdot day^{-1}$, the yield strength of 350 MPa, and the elongation rate of not less than 8%.

2. Potentiodynamic Polarization Curve Testing:

The magnesium alloy obtained in Examples 1-3 was subjected to potentiodynamic polarization curve testing in 3.5 wt % of an NaCl solution by adopting a PARSTAT 2273 electrochemical workstation. The polarization curve testing starts from being lower than an open circuit potential of 300 mV, and a scanning speed is 1 mV/s. The corrosion current density $I_{corr}$ of the magnesium alloy obtained in each example is as shown in Table 2

TABLE 2

| | Example 1 | Example 2 | Example 3 |
|---|---|---|---|
| $I_{corr}$(μA/cm$^2$) | 4.9 | 6.2 | 6.0 |

It may be seen from Table 2 that the corrosion-resistant ternary magnesium alloy prepared by the present disclosure has the same order of magnitude of $i_{corr}$ in 3.5 wt % of the NaCl aqueous solution at room temperature, which is less than 10 μA/cm$^2$.

At the same time, it may be seen that the corrosion-resistant ternary magnesium alloy Mg-10Y-0.8Al prepared in Example 1 has the best corrosion resistance, and $i_{corr}$ is 4.9 μA/cm$^2$.

The corrosion resistance comparison between the magnesium alloy prepared by the present disclosure and a magnesium alloy in the prior art is as shown in Table 3.

TABLE 3

| Sample | Corrosion current density (μA/cm$^2$) | Tensile strength (MPa) | Elongation rate (%) |
|---|---|---|---|
| Example 1 | 4.9 | 350 | 8 |
| Example 2 | 6.2 | 273 | 15 |
| AZ31[1] | 11.5 | 195 | 12.5 |
| ZK60AF[2] | 14 | 260 | 11.5 |

The detailed description of the properties of an AZ31 alloy comes from the reference: [1] Vrátná, J., Hadzima, B., Bukovina, M. & Janeček, M. Room temperature corrosion properties of AZ31 magnesium alloy processed by extrusion and equal channel angular pressing. Journal of Materials Science 48 (2013), 4510-4516.

The detailed description of the properties of a ZK60AF alloy comes from references: [2] Orlov, D., Ralston, K. D., Birbilis, N. & Estrin, Y. Enhanced corrosion resistance of Mg alloy ZK60 after processing by integrated extrusion and equal channel angular pressing, Acta Mater. 59 (2011) 6176-6186.

It may be concluded from Table 3 that the magnesium alloy obtained by the present disclosure has excellent mechanical properties and belongs to high-strength magnesium alloys. However, alloys with the better mechanical properties than this alloy have poor corrosion resistance. Meanwhile, the high-strength and high-corrosion-resistant ternary magnesium alloy obtained by the present disclosure, compared with other alloys, also has the better corrosion resistance than most other magnesium alloys. The magnesium alloy obtained by the present disclosure is an ideal magnesium alloy with high strength and high corrosion resistance.

It should be noted that the components of the magnesium alloy provided by the present disclosure is not limited to the range disclosed in the above examples, and as long as the components of alloys satisfy the conditions that the weight percentage content of Y is 8-12 wt %, the weight percentage content of Al is 0.6-3 wt % (preferably the weight percentage content of Y is 8-11 wt %, and the weight percentage content of Y is 0.6-1.5 wt %), the content of inevitable impurity element Fe does not exceed 0.1 wt %, the content of impurity element Cu does not exceed 0.02 wt %, and the content of impurity element Ni does not exceed 0.003 wt % (preferably the content of Fe does not exceed 0.02 wt %, the content of Cu does not exceed 0.01 wt %, and the content of Ni does not exceed 0.0005 wt %), the alloys all have good corrosion resistance; and sections obtained after solution treatment at 500-580° C. for 8-24 h, extrusion at 300-450° C. according to the extrusion ratio of (9-25):1, and operation of controlling the outflow speed of the section to be 5-10 m/min all have the better mechanical properties and maintain the better corrosion resistance.

Finally, it should be noted that the above preferred examples are merely used to illustrate the technical solution of the present disclosure and not to limit it. Although the present disclosure has been described in detail through the above preferred examples, those skilled in the art should understand that various changes in form and detail may be made to it without departing from the scope defined by the claims of the present disclosure.

What is claimed is:

1. A preparation method of a high-strength and high-corrosion-resistant ternary magnesium alloy, the method comprising the following steps:

(1) under a protective atmosphere, preparing a magnesium alloy melt from an Mg—Y master alloy, an aluminum ingot and a magnesium ingot;

(2) under the protective atmosphere, stirring the magnesium alloy melt, holding at 720-740° C. for 20-60 min, then performing refined degassing and deslagging at 730-750° C., holding again at 720-740° C., and performing heat preservation at 720-740° C. for 20-60 min to obtain a magnesium alloy liquid; and (3) under the protective atmosphere, casting the magnesium alloy liquid into a mold to form an ingot, and finally obtaining the corrosion-resistant ternary magnesium alloy, wherein the corrosion-resistant ternary magnesium alloy includes the following elements in percentage by weight: 8-12 wt % of Y, 0.6-3 wt % of Al, and the balance of Mg, and wherein the corrosion-resistant ternary magnesium alloy includes a lath-shaped LPSO phase and $Al_2Y$ particles, wherein the ingot is solution-treated to obtain the corrosion-resistant ternary magnesium alloy, wherein a temperature of the solution treatment is 500-580° C., a time of the solution treatment is 8-24 h.

2. The preparation method of the high-strength and high-corrosion-resistant ternary magnesium alloy according to claim 1, wherein preparing the magnesium alloy melt comprises the following specific steps: under the protective atmosphere, after the magnesium ingot is melted, adding the Mg—Y master alloy and the aluminum ingot at 660-700° C., and after the Mg—Y master alloy and the aluminum ingot are melted, obtaining the magnesium alloy melt.

3. The preparation method of the high-strength and high-corrosion-resistant ternary magnesium alloy according to claim 2, wherein a protective gas is a mixed gas of $SF_6$ and $CO_2$.

4. The preparation method of the high-strength and high-corrosion-resistant ternary magnesium alloy according to claim 1, wherein the ingot is solution-treated, and then is extruded and water-quenched to obtain the corrosion-resistant ternary magnesium alloy.

5. The preparation method of the high-strength and high-corrosion-resistant ternary magnesium alloy according to claim 4, wherein a temperature of extrusion is 300-450° C., an extrusion ratio is (9-30):1, and an outflow speed of an extruded section is 3-10 m/min.

6. The preparation method of the high-strength and high-corrosion-resistant ternary magnesium alloy according to claim 1, wherein a protective gas is a mixed gas of $SF_6$ and $CO_2$.

* * * * *